US010790588B2

(12) United States Patent
Ban

(10) Patent No.: US 10,790,588 B2
(45) Date of Patent: Sep. 29, 2020

(54) LOOP ANTENNA AND ELECTRONIC DEVICE

(71) Applicant: FUJITSU LIMITED, Kawasaki-shi, Kanagawa (JP)

(72) Inventor: Yasumitsu Ban, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 387 days.

(21) Appl. No.: 15/808,705

(22) Filed: Nov. 9, 2017

(65) Prior Publication Data

US 2018/0145410 A1 May 24, 2018

(30) Foreign Application Priority Data

Nov. 24, 2016 (JP) ..... 2016-228120

(51) Int. Cl.

| | |
|---|---|
| ***H01Q 1/38*** | (2006.01) |
| ***H01Q 7/00*** | (2006.01) |
| ***H01Q 9/04*** | (2006.01) |
| *H01Q 1/22* | (2006.01) |

(52) U.S. Cl.
CPC ..... *H01Q 7/00* (2013.01); *H01Q 1/38* (2013.01); *H01Q 9/0421* (2013.01); *H01Q 1/2208* (2013.01)

(58) Field of Classification Search
CPC ..... H01Q 1/38; H01Q 7/00; H01Q 1/2208; H01Q 9/0421
See application file for complete search history.

(56) References Cited

U.S. PATENT DOCUMENTS

| | | | | |
|---|---|---|---|---|
| 5,903,240 | A * | 5/1999 | Kawahata | H01Q 1/243 343/700 MS |
| 6,369,762 | B1 * | 4/2002 | Yanagisawa | H01Q 1/38 343/700 MS |
| 7,405,697 | B2 * | 7/2008 | Ying | H01Q 1/243 343/700 MS |
| 8,547,184 | B2 * | 10/2013 | Washiro | H01P 5/085 333/220 |
| 8,963,794 | B2 * | 2/2015 | Zhu | H01Q 1/2283 343/702 |
| 2006/0032926 | A1 * | 2/2006 | Baba | G06K 19/07749 235/492 |
| 2007/0115200 | A1 * | 5/2007 | Ishimiya | H01Q 9/26 343/803 |

(Continued)

FOREIGN PATENT DOCUMENTS

| | | |
|---|---|---|
| JP | 2007-142799 A | 6/2007 |
| JP | 2009-152722 A | 7/2009 |
| JP | 2014-072874 A | 4/2014 |

*Primary Examiner* — Ab Salam Alkassim, Jr.
(74) *Attorney, Agent, or Firm* — Arent Fox LLP

(57) ABSTRACT

A loop antenna includes: a substrate; a first conductor which is provided on a first surface of the substrate, is conductive and is grounded; a second conductor which is formed as a loop to surround the substrate along a surface orthogonal to the first surface, is conductive, is fed on a second surface of the substrate, which is opposite to the first surface, and is electrically connected to the first conductor; and a third conductor which is provided on at least one side surface of the substrate, which intersects the surface on which the second conductor is formed as a loop, is conductive and is electrically connected to the first conductor.

5 Claims, 10 Drawing Sheets

(56) References Cited

U.S. PATENT DOCUMENTS

| | | | | |
|---|---|---|---|---|
| 2007/0193021 | A1* | 8/2007 | Kobayashi | G06K 19/07752 29/601 |
| 2008/0003713 | A1* | 1/2008 | Kobayashi | G06K 19/07749 438/106 |
| 2008/0117117 | A1* | 5/2008 | Washiro | H01Q 9/42 343/850 |
| 2009/0160717 | A1 | 6/2009 | Tsutsumi et al. | |
| 2011/0068904 | A1* | 3/2011 | Baba | G06K 19/07749 340/10.1 |
| 2014/0361089 | A1* | 12/2014 | Kai | H01Q 1/38 235/492 |
| 2016/0321535 | A1* | 11/2016 | Ban | G06K 19/07786 |
| 2017/0300801 | A1* | 10/2017 | Kai | H01Q 1/2208 |
| 2018/0151956 | A1* | 5/2018 | Ban | H01Q 1/48 |
| 2018/0358703 | A1* | 12/2018 | Ban | H01Q 7/00 |
| 2018/0366827 | A1* | 12/2018 | Yamagajo | H01Q 1/38 |

* cited by examiner

LOOP ANTENNA AND ELECTRONIC DEVICE

CROSS-REFERENCE TO RELATED APPLICATION

This application is based upon and claims the benefit of priority of the prior Japanese Patent Application No. 2016-228120, filed on Nov. 24, 2016, and the entire contents of which are incorporated herein by reference.

FIELD

The embodiments discussed herein are related to a loop antenna and an electronic device that includes a loop antenna.

BACKGROUND

Conventionally, a loop antenna has been used for various purposes. However, in an environment where a loop antenna is installed in the vicinity of a conductor, the radiation characteristics or the like of the loop antenna may change, and desirable radiation characteristics of the loop antenna may not be obtained. In view of this, such an antenna apparatus has been proposed, which can possibly suppress the variations in impedance properties and the degradation of radiation properties, even when a loss material or a metal is close to the antenna (for example, refer to Japanese Laid-open Patent Publication No. 2009-152722).

For example, the antenna apparatus described in Japanese Laid-open Patent Publication No. 2009-152722 includes a dipole element including first and second linear elements, in which respective ends thereof are disposed adjacent to each other, and a loop-shaped element including third and fourth linear elements approximately in parallel with the first and the second linear element, respective ends of the third and fourth linear elements being disposed adjacent to each other. This antenna apparatus is fed from the respective ends of the first and the second adjacent linear elements, and from the respective ends of the adjacent third and the fourth linear elements.

SUMMARY

In the antenna apparatus disclosed in Japanese Laid-open Patent Publication No. 2009-152722, the current flowing through the dipole element and the current flowing through the linear element of the loop-shaped element at the dipole element side are opposite in phase and cancel each other out. Therefore, the effect of a loss material or a metal disposed at the dipole element side is alleviated. As a result, the degradation in radiation efficiency is suppressed.

However, the antenna apparatus disclosed in Japanese Laid-open Patent Publication No. 2009-152722 includes a dipole element in addition to a loop-shaped element. Therefore, the area needed for installation becomes larger than the loop antenna itself. This prevents usage of the antenna apparatus in an apparatus that has a limited area for installation of an antenna. In view of this, a loop antenna having an improved antenna gain, which is usable even when the radiation characteristics of the loop antenna are changed due to the installation of the loop antenna in the vicinity of a conductor, such as metal, is desired.

According to one embodiment, a loop antenna is provided. The loop antenna includes: a substrate; a first conductor which is provided on a first surface of the substrate, is conductive and is grounded; a second conductor which is formed as a loop to surround the substrate along a surface orthogonal to the first surface, is conductive, is fed on a second surface of the substrate, which is opposite to the first surface, and is electrically connected to the first conductor; and a third conductor which is provided on at least one side surface of the substrate, which intersects the surface on which the second conductor is formed as a loop, is conductive and is electrically connected to the first conductor.

According to another embodiment, an electronic device is provided. The electronic device includes: a loop antenna; a signal processing circuit configured to radiate or receive a radio wave via the loop antenna; and a matching circuit connected between the loop antenna and the signal processing circuit, the matching circuit being configured to match an impedance of the loop antenna with an impedance of the signal processing circuit, wherein the loop antenna includes: a substrate; a first conductor which is provided on a first surface of the substrate, is conductive and is grounded; a second conductor which is formed as a loop to surround the substrate along a surface orthogonal to the first surface, is conductive, is fed on a second surface of the substrate, which is opposite to the first surface, and is electrically connected to the first conductor; and a third conductor which is provided on at least one side surface of the substrate, which intersects the surface on which the second conductor is formed as a loop, is conductive and is electrically connected to the first conductor, and the signal processing circuit and the matching circuit are provided on an area of the second surface of the substrate, in which the second conductor is not formed.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

The following describes a loop antenna with reference to the drawings. This loop antenna includes a conductor formed as a loop to surround a substrate along the section of the substrate in the vicinity of one end of the substrate on which a signal processing circuit or the like is mounted. The conductor formed as a loop is electrically connected to a grounded conductor mounted on one surface of the substrate. A radiation conductor to electrically connect to the grounded conductor is provided on at least one side surface of the substrate in a direction intersecting with a surface on which the loop is formed. Accordingly, the area for the conductor functioning as an antenna increases, which results in an improvement in antenna gain.

For ease of understanding, in the following embodiments or modification examples, the surface (second surface) of a substrate on which a signal processing circuit and a power feeding point are mounted is referred to as "front surface", and the surface (first surface) opposite to the front surface of the substrate is referred to as a back surface. In addition, the length in the widthwise direction of a substrate may be referred to as a width of a substrate, and the length in the lengthwise direction of the substrate may be simply referred to as a length of a substrate.

Figure 1A:
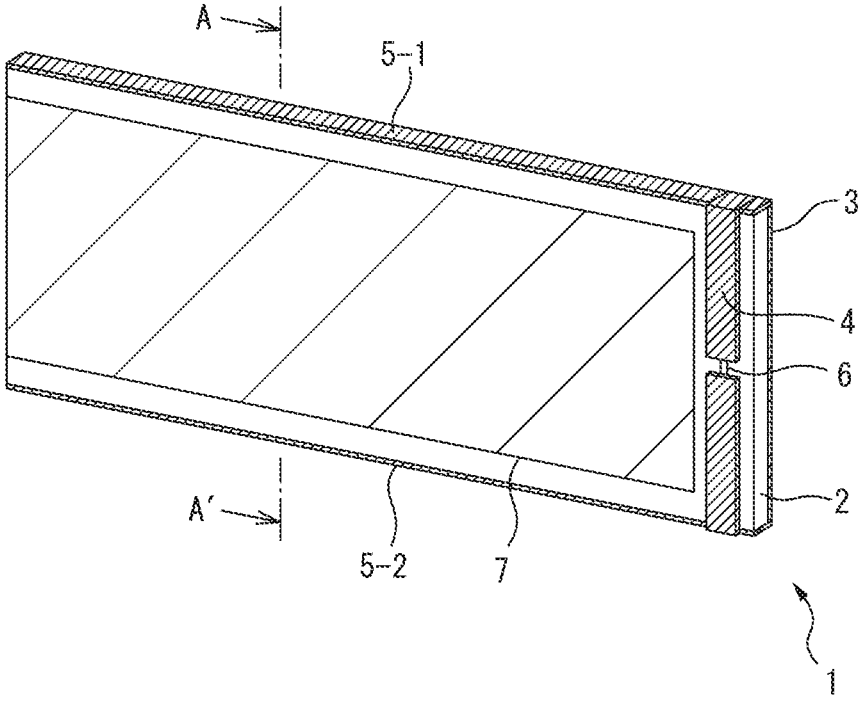
FIG. 1A is a perspective view of a loop antenna according to a first embodiment.
Figure 1B:
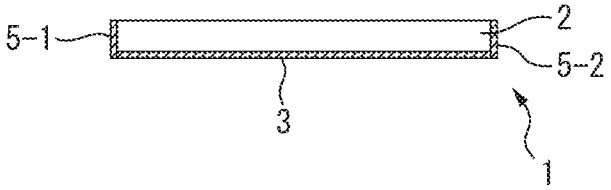
FIG. 1B is a sectional view of the loop antenna according to the first embodiment taken along line AA' in FIG. 1A.
Figure 1C:
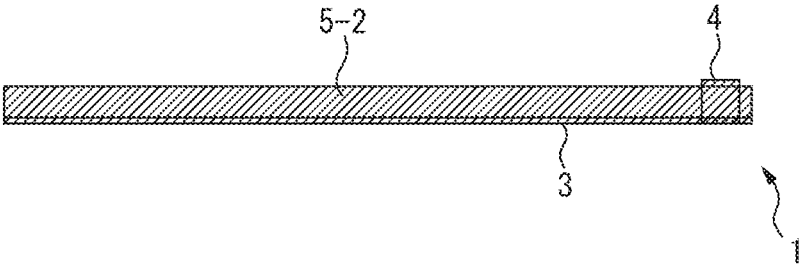
FIG. 1C is a side view of the loop antenna according to the first embodiment, viewed from the long side of the substrate.

FIG. 1A is a perspective view of a loop antenna according to a first embodiment. FIG. 1B is a sectional view of the loop antenna according to the first embodiment taken along line AA' in FIG. 1A. FIG. 1C is a side view of the loop antenna according to the first embodiment, viewed from the long side of the substrate.

The loop antenna 1 according to the first embodiment includes a substrate 2, a grounded conductor 3, a loop radiation conductor 4, and two radiation conductors 5-1 and 5-2.

The substrate 2 is formed, for example, by a dielectric such as a synthetic resin, for example, an ABS resin, a PET resin, or a polycarbonate resin, to have a rectangular plate shape. On the front surface of the substrate 2, for example, a signal processing circuit for radio communication using the loop antenna 1 is mounted.

The grounded conductor 3 is an example of a first conductor which is grounded, and is formed, for example, by a conductor such as copper or gold. The grounded conductor 3 is provided, for example, to cover the entire back surface of the substrate 2 and is grounded. The grounded conductor 3 may be formed to cover a part of the back surface of the substrate 2. In this case, it is preferable that the grounded conductor 3 is provided to the portion near one end of the substrate 2 in a lengthwise direction at which the loop radiation conductor 4 is provided as well as the portion along a long side of the substrate 2, so that the grounded conductor 3 is electrically connected to the loop radiation conductor 4 and the radiation conductors 5-1 and 5-2.

The loop radiation conductor 4 is an example of a second conductor formed as a loop, and is provided in the vicinity of one end of the substrate 2 in the lengthwise direction (right end in FIG. 1A), for example. The loop radiation conductor 4 is formed by a conductor such as copper and gold, and is provided as a loop to surround the circumference of the substrate 2 along the surface orthogonal to the back surface of the substrate 2 and the widthwise direction of the substrate 2. The loop radiation conductor 4 has, on a surface on which the loop is shaped, a rectangular shape having two long sides along the front surface or the back surface of the substrate 2 and two short sides along the side surface of the substrate 2. The conductor forming the loop radiation conductor 4 has a certain width in a direction intersecting the surface on which a loop is shaped, i.e., along the lengthwise direction of the substrate 2. Therefore, loop radiation conductor 4 has a three-dimensional shape.

Power feeding point 6 is provided on both ends of the loop radiation conductor 4 at the front surface side of the substrate 2, and the both ends are opposite to each other. The loop radiation conductor 4 is electrically connected via the power feeding point 6 to a signal processing circuit (not illustrated in the drawings) that processes a signal which is received by the loop antenna 1 or is superposed on the radio wave which is radiated. A matching circuit (not illustrated in the drawings) may be connected between the power feeding point 6 and the signal processing circuit so as to match the impedance of the loop antenna 1 and the impedance of the signal processing circuit. For example, the loop radiation conductor 4, in cooperation with the radiation conductors 5-1 and 5-2, radiates a radio wave or receives a radio wave.

The radio efficiency of the loop antenna 1 improves as the width of the loop radiation conductor 4 along the lengthwise direction of the substrate 2 increases. However, because various components, such as a signal processing circuit, are mounted on the front surface of the substrate 2, the width of the loop radiation conductor 4 is preferably large, to the extent not interfering with the component installment space 7 in which various components are placed. The distance from one end of the substrate 2 in the lengthwise direction to the loop radiation conductor 4 is not particularly limited in view of the antenna's radiation property, and may be set so as not to interfere with the component installment space 7.

The loop radiation conductor 4 is formed, for example, such that its circumferential length is substantially equal to the electrical length of the designed wavelength. The length of the circumference of the loop radiation conductor 4 may be different from the electrical length of the designed wavelength, depending on the required specifications.

Furthermore, the loop radiation conductor 4 is electrically connected to the grounded conductor 3 on the back surface of the substrate 2. The loop radiation conductor 4 and the grounded conductor 3 may be integrally formed by a single conductor.

The radiation conductor 5-1 is formed on a side surface of the substrate 2, which intersects the surface on which the loop of the loop radiation conductor 4 is formed, by a conductor such as copper and gold, for example. In the present embodiment, the radiation conductor 5-1 is formed on a side surface along the lengthwise direction of the substrate 2. The radiation conductor 5-2 is also formed from a conductor such as copper and gold, for example, and formed on a side surface that is along the lengthwise direction of the substrate 2 and that is opposite to the side surface on which the radiation conductor 5-1 is mounted. In the example illustrated in FIG. 1A, the radiation conductor 5-1 is formed to cover the entire upper side surface of the substrate 2, and meanwhile the radiation conductor 5-2 is formed to cover the entire lower side surface of the substrate 2. The radiation conductors 5-1 and 5-2 are examples of a third conductor.

One end of each of the radiation conductor 5-1 and the radiation conductor 5-2 on the back surface of the substrate 2 is electrically connected to the grounded conductor 3. In addition, each of the radiation conductor 5-1 and the radiation conductor 5-2 is electrically connected to the loop radiation conductor 4. As a result, the radiation conductor 5-1 and the radiation conductor 5-2, together with the loop radiation conductor 4, radiate or receive a radio wave. Thus, the area of the conductors used for radiation or reception of a radio wave is larger than the area when only the loop radiation conductor 4 is used for radiation or reception of a radio wave, and therefore the radiation characteristics of the loop antenna 1 improve.

Each conductor may be provided on the substrate 2 by evaporation or may be provided on the substrate 2 using any other processing method.

The following explains the radiation characteristics of the loop antenna 1, which is obtained by electromagnetic field simulation.

Figure 2:
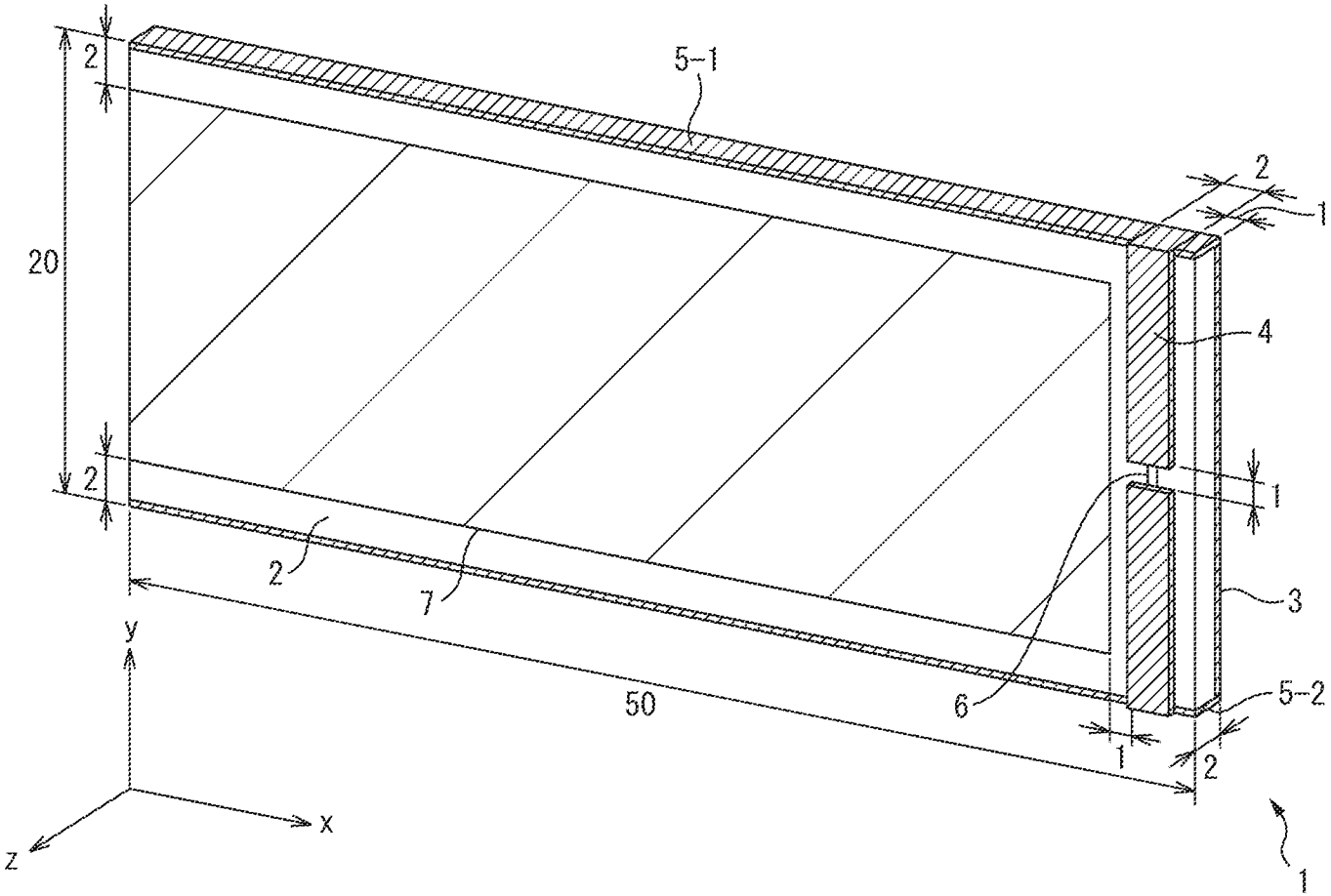
FIG. 2 is a perspective view of the loop antenna according to the first embodiment viewed from the front surface side, which indicates the size of each part used for electromagnetic field simulation of the frequency characteristics of the loop antenna.

FIG. 2 is a perspective view of the loop antenna 1 according to the first embodiment viewed from the front surface side, which indicates the size of each part used for electromagnetic field simulation of the radiation characteristics of the loop antenna. In this simulation, the relative permittivity $\varepsilon r$ of the substrate 2 is 3.2, and the dielectric loss tangent tan $\delta$ of the substrate 2 is 0.02. The length of the substrate 2 is 50 mm, the width is 20 mm, and the thickness of the substrate 2 is 2 mm.

The conductance of the grounded conductor 3, the loop radiation conductor 4, and the radiation conductors 5-1 and 5-2 is $1.0\times10^5$ (S/m). The grounded conductor 3 covers the entire back surface of the substrate 2, and each of the radiation conductors 5-1 and 5-2 entirely covers one of the two side surfaces along the lengthwise direction of the substrate 2. The width of the loop radiation conductor 4 along the lengthwise direction of the substrate 2 is 2 mm, and the distance from the right end of the substrate 2 to the loop radiation conductor 4 is 1 mm. At the power feeding point 6, the interval between one end and another end of the loop radiation conductor 4 is 1 mm. On the front surface of the substrate 2, a component installment space 7 is provided in an area 1 mm away from the loop radiation conductor 4 to the left end of the substrate 2 in the lengthwise direction, and 2 mm away from each of the side surfaces of the substrate 2 along the lengthwise direction. The component installment space 7 is also covered with a conductor having a conductance of $1.0\times10^5$ (S/m). For electromagnetic field simulation, a coordinate system is set in which the origin is the center of the front surface of the substrate 2, the normal direction with respect to the front surface of the substrate 2 is the z-axis, the lengthwise direction of the substrate 2 is the x-axis, and the widthwise direction of the substrate 2 is the y-axis.

Furthermore, as a comparative example for electromagnetic field simulation explained below, a loop antenna in which the radiation conductors 5-1 and 5-2 are omitted from among parts of the loop antenna 1 is used.

Figure 3B:
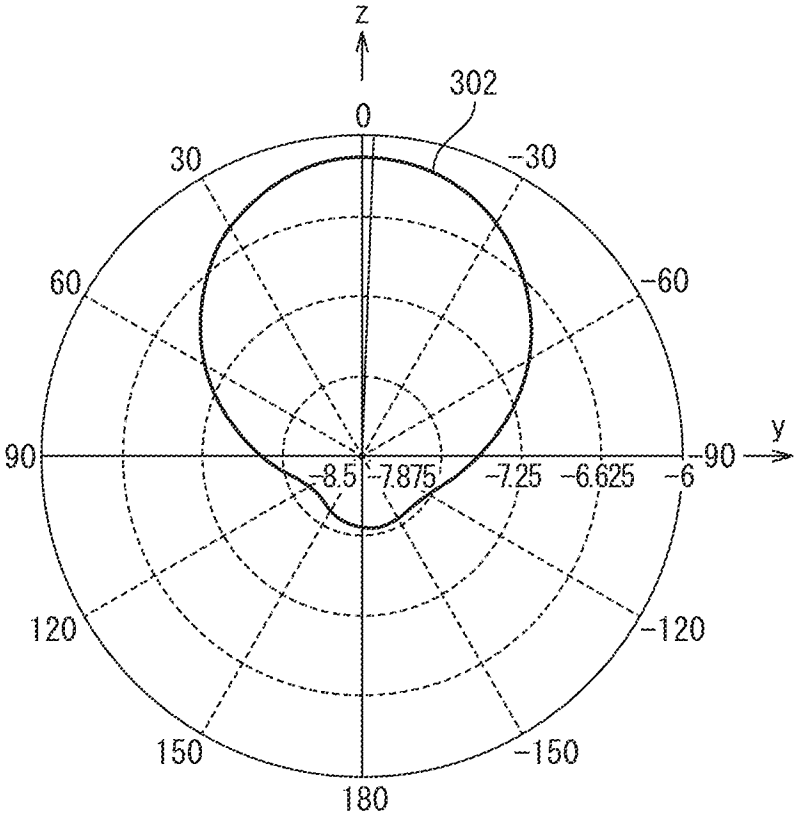
FIG. 3B is a diagram illustrating a radiation pattern of the loop antenna according to the first embodiment with respect to a radio wave having a frequency of 2.45 GHz obtained by electromagnetic field simulation.
Figure 3A:
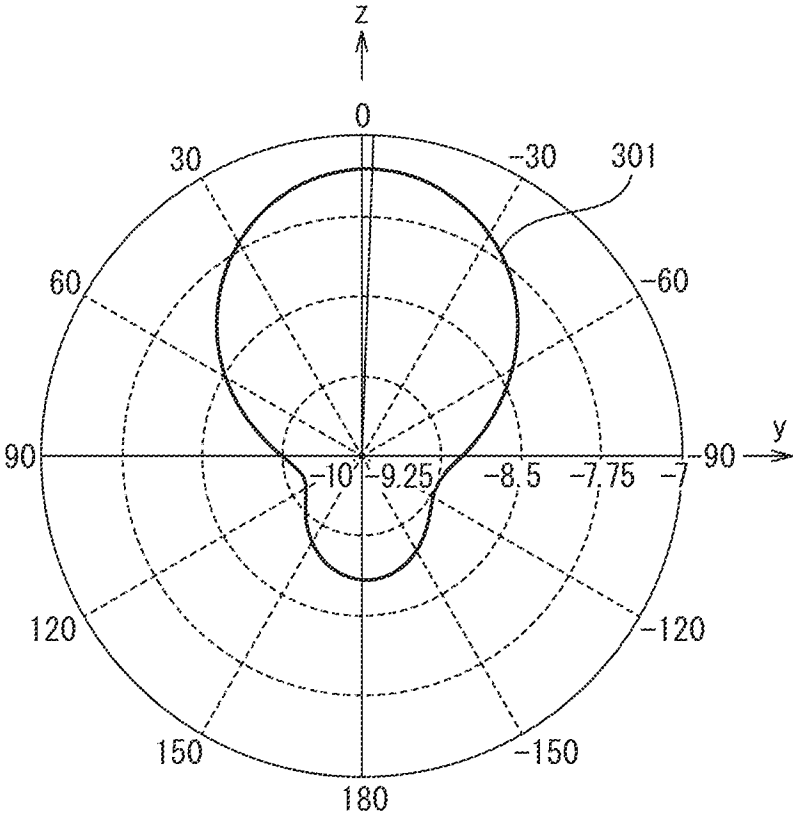
FIG. 3A is a diagram illustrating a radiation pattern of a loop antenna according to a comparative example with respect to a radio wave having a frequency of 2.45 GHz obtained by electromagnetic field simulation.

FIG. 3A illustrates the radiation pattern of a loop antenna according to a comparative example with respect to the radio wave having a frequency of 2.45 GHz obtained by electromagnetic field simulation. FIG. 3B illustrates a radiation pattern of the loop antenna 1 according to the first embodiment with respect to the radio wave having a frequency of 2.45 GHz obtained by the electromagnetic field simulation. Pattern 301 illustrated in FIG. 3A represents a position at which the antenna gain of the loop antenna according to the comparative example on the yz plane, when viewed from the right end of the substrate 2 in FIG. 2, is −7.33 dB. The pattern 302 illustrated in FIG. 3B represents a position at which the antenna gain of the loop antenna 1 according to the first embodiment on the yz plane when viewed from the right end of the substrate 2 in FIG. 2 is −6.175 dB. In FIG. 3A and FIG. 3B, 0° indicates the direction that is parallel to the normal direction with respect to the front surface of the substrate 2 and that is towards the front surface from the back surface of the substrate 2 (hereinafter referred to as the "front direction").

The distance from the front surface of the substrate 2 to the position at which the antenna gain is −7.33 dB (Pattern 301) and the distance from the front surface of the substrate 2 to the position at which the antenna gain is −6.175 dB (Pattern 302) are substantially equal to each other. This indicates that the antenna gain of the loop antenna 1 according to the first embodiment is better by about 1 dB than the antenna gain of the loop antenna according to the comparative example.

Figure 4:
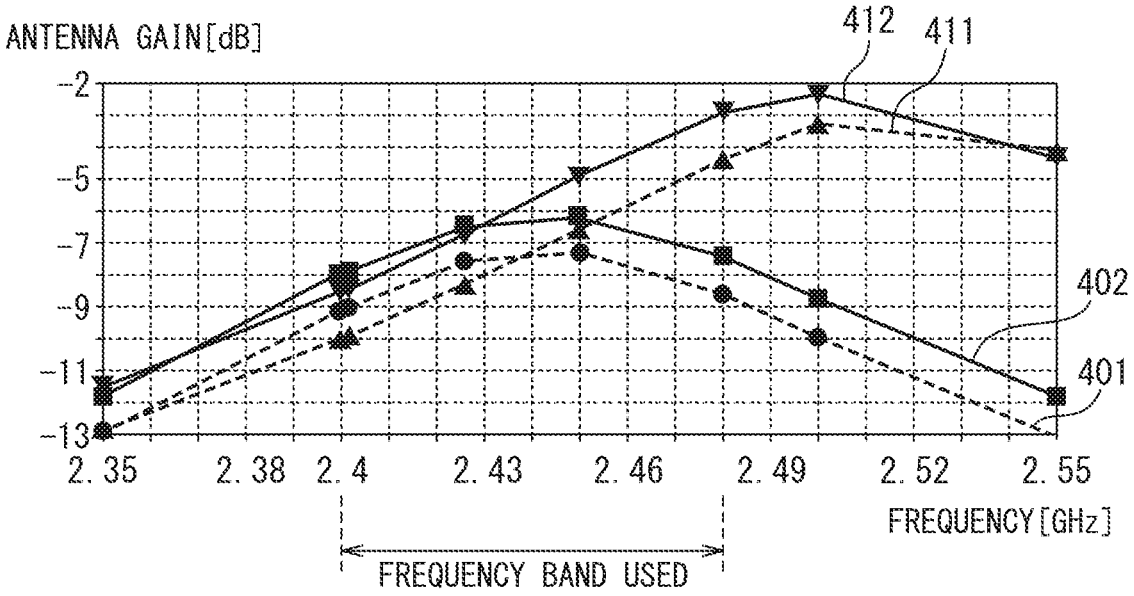
FIG. 4 is a diagram illustrating the frequency characteristics of an antenna gain in the front direction, when the loop antenna according to the comparative example and the loop antenna according to the first embodiment are placed in the air and when the loop antenna according to the comparative example and the loop antenna according to the first embodiment are placed on a base formed by a conductor.

FIG. 4 illustrates the frequency characteristics of an antenna gain in the front direction when the loop antenna according to the comparative example and the loop antenna 1 according to the first embodiment are placed in the air and when the loop antenna according to the comparative example and the loop antenna 1 are placed on a base formed by a conductor. In FIG. 4, the horizontal axis represents a frequency, and the vertical axis represents an antenna gain in the front direction in the impedance matched state. In this electromagnetic field simulation, as the frequency band to be used, a frequency band of 2.402 GHz to 2.480 GHz, which is used in Bluetooth Low Energy (BLE) (registered trademark), which is one short-range radio communication specification, is assumed.

In electromagnetic field simulation, the base on which each loop antenna is placed has a length in a direction parallel to the lengthwise direction of the substrate 2 of 140 mm, and a length in a direction parallel to the widthwise direction of the substrate 2 of 60 mm, and a thickness of 20 mm. Each loop antenna is placed at a position in which the distance from the end of the substrate on which the loop conductor element is mounted in the lengthwise direction to one end of the base in the lengthwise direction is 43 mm, and the distance from the opposite end of the substrate 2 to the opposite end of the base is 47 mm. In each loop antenna, the center of each loop antenna in the widthwise direction of the substrate 2 matches the center of the base in the widthwise direction (i.e., each loop antenna is located at a position at which the distance from the end of the substrate 2 to the end of the base is 20 mm in the widthwise direction for both sides of the substrate 2). In addition, each loop antenna is located so that the loop antenna's grounded conductor and the base contact with each other.

The graph 401 represents the frequency characteristics of the antenna gain for the loop antenna according to the comparative example placed in the air, and the graph 402 represents the frequency characteristics of the antenna gain for the loop antenna 1 according to the first embodiment placed in the air. The graph 411 represents the frequency characteristics of the antenna gain for the loop antenna according to the comparative example placed on a base formed by a conductor, and graph 412 represents the frequency characteristics of the antenna gain for the loop antenna 1 according to the first embodiment placed on a base formed by a conductor.

As indicated by the graph 401 and the graph 402, when each loop antenna is placed in the air, the antenna gain of the loop antenna 1 according to the first embodiment is higher than the antenna gain of the loop antenna according to the comparative example. Likewise, as indicated by the graph 411 and the graph 412, when each loop antenna is placed on a base formed by a conductor, the antenna gain of the loop antenna 1 according to the first embodiment is higher than the antenna gain of the loop antenna according to the comparative example. Furthermore, in the frequency band used in the BLE, the antenna gain of the loop antenna 1 according to the first embodiment is hardly degraded even when the loop antenna 1 is placed on a base formed by a conductor. In a frequency higher than 2.43 GHz, the antenna gain of the loop antenna 1 when the loop antenna 1 is placed on a base formed by a conductor, is higher than the antenna gain of the loop antenna 1 when the loop antenna 1 is placed in the air.

As described above, in this loop antenna, on the side surface of the substrate intersecting the surface on which the loop of the loop radiation conductor is formed, the radiation conductor which is electrically connected to the grounded conductor is mounted. This increases the area of the conductor to radiate or receive a radio wave, and therefore this loop antenna can improve the radiation characteristics. In addition, even when this loop antenna is placed so that the grounded conductor is in contact with another conductor, the degradation in radiation property is suppressed in a certain frequency band. Furthermore, in this loop antenna, only a part of the conductor formed as a loop is mounted on the front surface of the substrate on which the signal processing circuit or the like is mounted. Therefore, it becomes possible to effectively use the front surface of the substrate. As a result, in this loop antenna, the size of the entire apparatus in which a loop antenna is installed can be reduced.

Figure 5A:
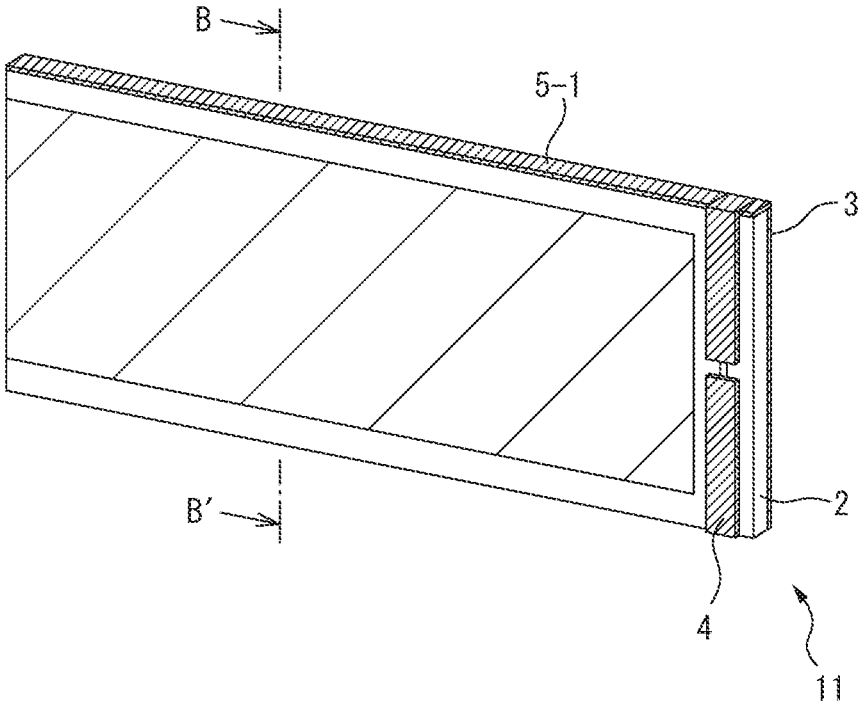
FIG. 5A is a perspective view of a loop antenna according to a modification example, viewed from the front surface side of the substrate.
Figure 5B:
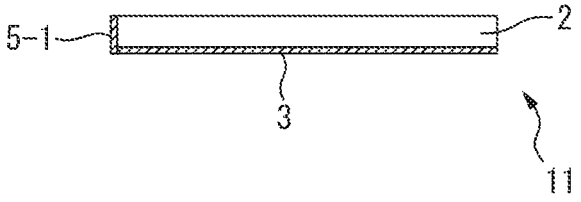
FIG. 5B is a sectional view of the loop antenna according to the modification example taken along line BB' in FIG. 5A.

In a modification example, one of the two radiation conductors 5-1 and 5-2 may be omitted. FIG. 5A is a perspective view of a loop antenna 11 according to this modification example, viewed from the front surface side of the substrate. FIG. 5B is a sectional view of the loop antenna 11 taken along line BB' in FIG. 5A. The loop antenna 11 according to this modification example includes a substrate 2, a grounded conductor 3, a loop radiation conductor 4, and a radiation conductor 5-1. The loop antenna 11 is different from the loop antenna 1 according to the first embodiment, in that there is no radiation conductor 5-2 on one of the side surfaces of the substrate 2 in the lengthwise direction.

Figure 6:
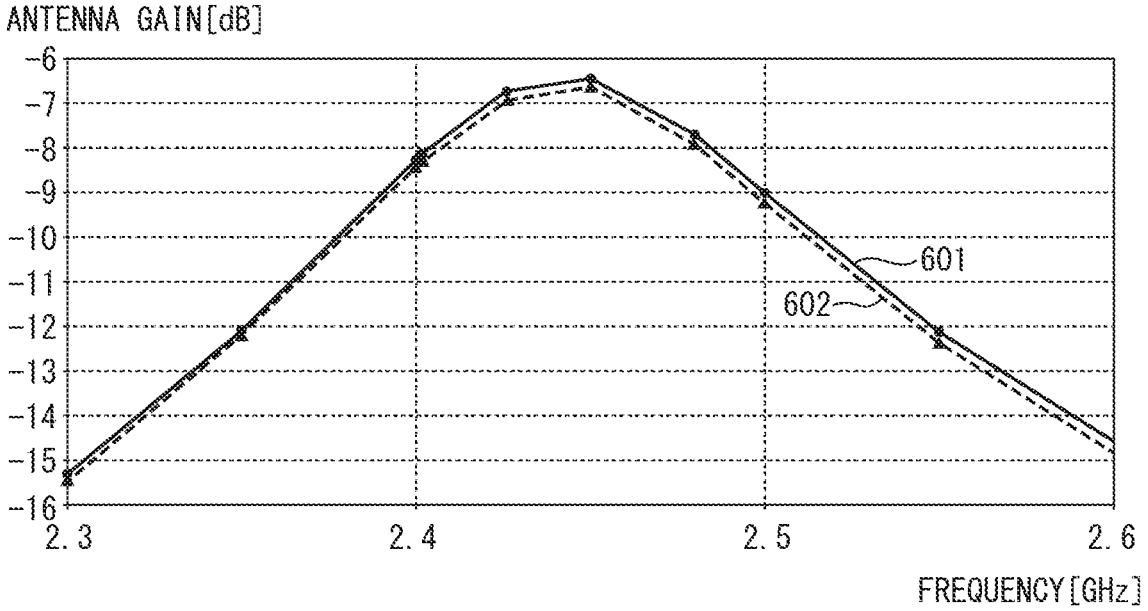
FIG. 6 is a diagram illustrating the frequency characteristics of an antenna gain in the front direction obtained by electromagnetic field simulation, when the loop antenna according to the first embodiment and the loop antenna according to the modification example are placed in the air.

FIG. 6 illustrates the frequency characteristics of an antenna gain in the front direction obtained by electromagnetic field simulation, when the loop antenna 1 according to the first embodiment and the loop antenna 11 according to the modification example are placed in the air. Note that in this electromagnetic field simulation, the size of each part of the loop antenna 1 and the loop antenna 11 is assumed to be the same as those in FIG. 2.

In FIG. 6, the horizontal axis represents a frequency, and the vertical axis represents an antenna gain in the front direction in the impedance matched condition. The graph 601 represents frequency characteristics of the antenna gain for the loop antenna 1 according to the first embodiment, and the graph 602 represents frequency characteristics of the antenna gain for the loop antenna 11 according to the modification example. As indicated by the graph 601 and the graph 602, the frequency characteristics of the antenna gain for the loop antenna 11 are substantially the same as the frequency characteristics of the antenna gain for the loop antenna 1.

Figure 7:
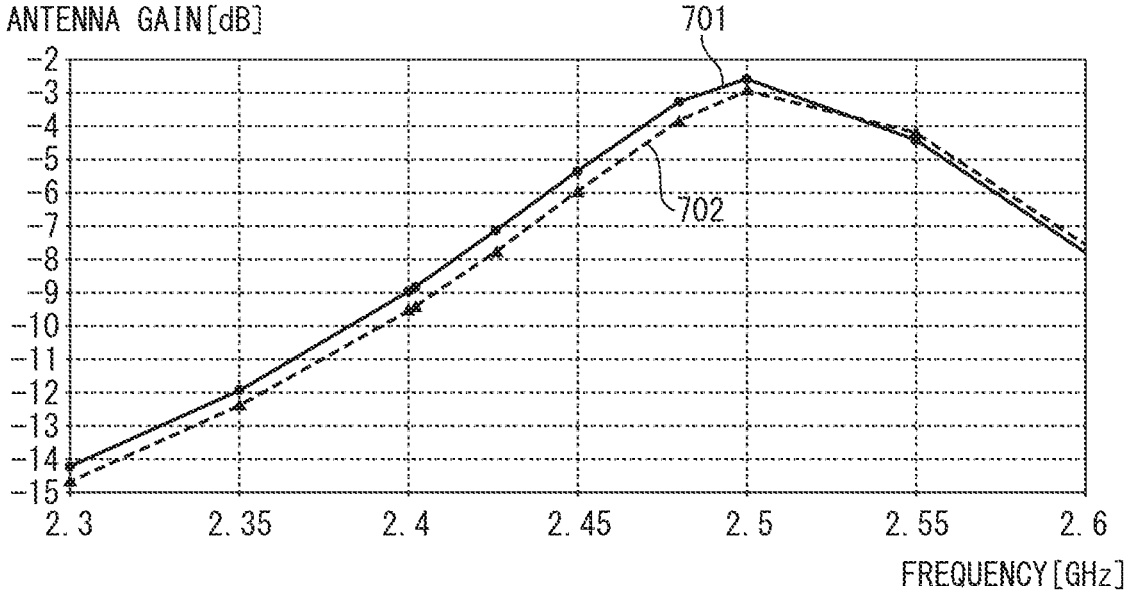
FIG. 7 is a diagram illustrating the frequency characteristics of an antenna gain in the front direction obtained by electromagnetic field simulation, when the loop antenna according to the first embodiment and the loop antenna according to the modification example are placed on a base formed by a conductor.

FIG. 7 is a diagram illustrating the frequency characteristics of an antenna gain in the front direction obtained by electromagnetic field simulation, when the loop antenna 1 according to the first embodiment and the loop antenna 11 according to the modification example are placed on a base formed by a conductor. Note that also in this electromagnetic field simulation, the size of each part of the loop antenna 1 and the loop antenna 11 is assumed to be the same as those in FIG. 2. In addition, the base on which each loop antenna is placed is assumed to be the same as that used in the electromagnetic field simulation in FIG. 4.

In FIG. 7, the horizontal axis represents a frequency, and the vertical axis represents an antenna gain in the front direction in the impedance matched condition. The graph 701 represents frequency characteristics of the antenna gain for the loop antenna 1 according to the first embodiment, and the graph 702 represents frequency characteristics of the antenna gain for the loop antenna 11 according to the modification example. As indicated by graph 701 and graph 702, the frequency characteristics of the antenna gain for the loop antenna 11 are substantially the same as the frequency characteristics of the antenna gain for the loop antenna 1.

From the above, it can be understood that the loop antenna 11 according to the modification example has substantially the same radiation characteristics as that of the loop antenna 1. By omitting one of the radiation conductors, the impedance of the loop antenna varies. Therefore, the matching circuit for the loop antenna 11 according to the modification example is separately designed from the matching circuit for the loop antenna 1 according to the first embodiment.

According to a still another modification example, a part of the radiation conductors 5-1 and 5-2 may extend up to the surface opposite to the surface on which the grounded conductor 3 is formed, i.e., up to the front surface side of the substrate 2.

Figure 8A:
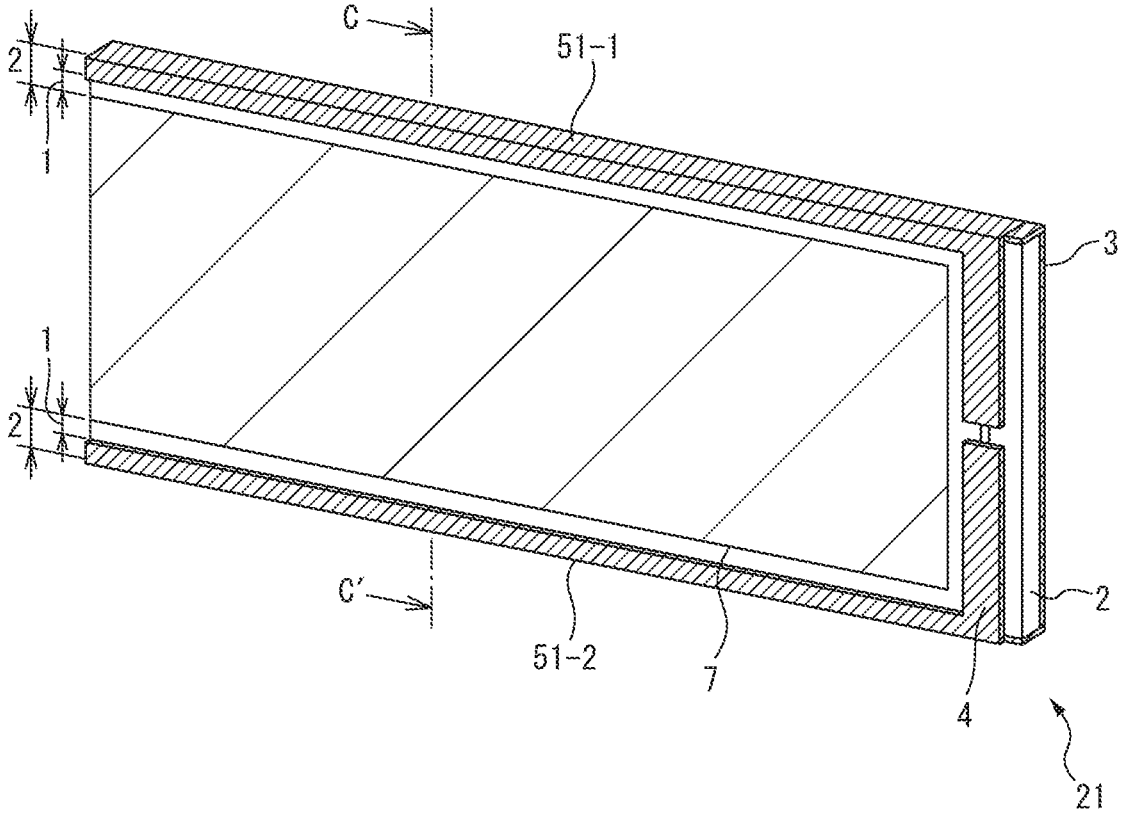
FIG. 8A is a perspective view of a loop antenna according to another modification example, viewed from the front surface side of the substrate.
Figure 8B:
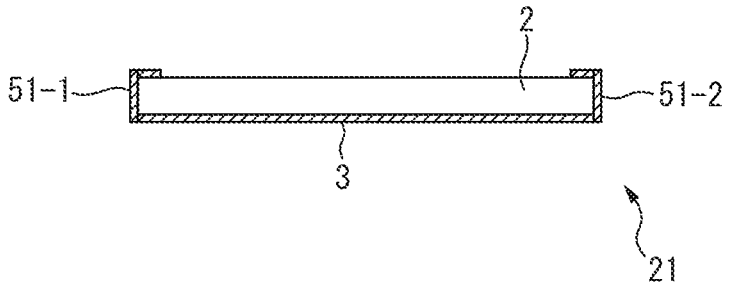
FIG. 8B is a sectional view of the loop antenna according to the other modification example taken along line CC' in FIG. 8A.

FIG. 8A is a perspective view of a loop antenna 21 according to another modification example, viewed from the front surface side of the substrate. FIG. 8B is a sectional view of the loop antenna 21 taken along line CC' in FIG. 8A. The loop antenna 21 according to this modification example includes a substrate 2, a grounded conductor 3, a loop radiation conductor 4, and two radiation conductors 51-1 and 51-2. The loop antenna 21 is different from the loop antenna 1 according to the first embodiment, in that the two radiation conductors 51-1 and 51-2 extend up to the front surface side of the substrate 2. Note that the position of the ends of the radiation conductors 51-1 and 51-2 on the front surface of the substrate 2 may be any position as long as the radiation conductors 51-1 and 51-2 do not interfere with the component installment space 7. Note that the radiation conductors 51-1 and 51-2 are another example of the third conductor.

Figure 9A:
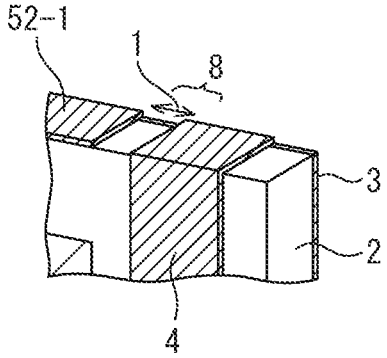
FIG. 9A is a partial perspective view of a part of a loop antenna of a still another modification example, viewed from the front surface side of the substrate.
Figure 9B:
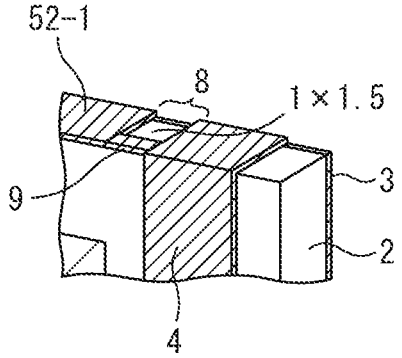
FIG. 9B is a partial perspective view of a part of a loop antenna of a still another modification example, viewed from the front surface side of the substrate.

FIG. 9A and FIG. 9B are each a partial perspective view of a part of a loop antenna of a still another modification example, viewed from the front surface side of the substrate 2. The loop antenna according to these modification examples is different from the loop antenna 1 according to the first embodiment in the shape of the radiation conductor but is the same in the other points as the loop antenna 1 according to the first embodiment. In the modification example illustrated in FIG. 9A, a gap 8 is formed between an end of the radiation conductor 52-1 of the loop radiation conductor 4 side and the loop radiation conductor 4 so as to prevent the radiation conductor 52-1 formed on a side surface of the substrate 2 from being directly connected to the loop radiation conductor 4. In addition, although not illustrated in the drawings, a gap may also be formed similarly for the opposite-side radiation conductor between the corresponding radiation conductor and the loop radiation conductor 4. The radiation conductor 52-1 is still another example of the third conductor.

Also in the modification example illustrated in FIG. 9B, the radiation conductor 52-1 is electrically connected to the loop radiation conductor 4 via a bridge conductor 9 which is formed along one end of the gap 8 that is closer to the front surface of the substrate 2, in the gap 8 in the modification example illustrated in FIG. 9A. However, the bridge conductor 9 is not in contact with the grounded conductor 3. In this modification example as well, although not illustrated in the drawings, as to the opposite-side radiation conductor, the radiation conductor may be electrically connected to the loop radiation conductor via a bridge conductor which is formed in a gap between the radiation conductor and the loop radiation conductor 4. Note that the bridge conductor 9 is formed, for example, by copper or gold. Furthermore, according to this modification example as well, the grounded conductor 3, the loop radiation conductor 4, the two radiation conductors, and the bridge conductor may be integrally formed.

Figure 10:
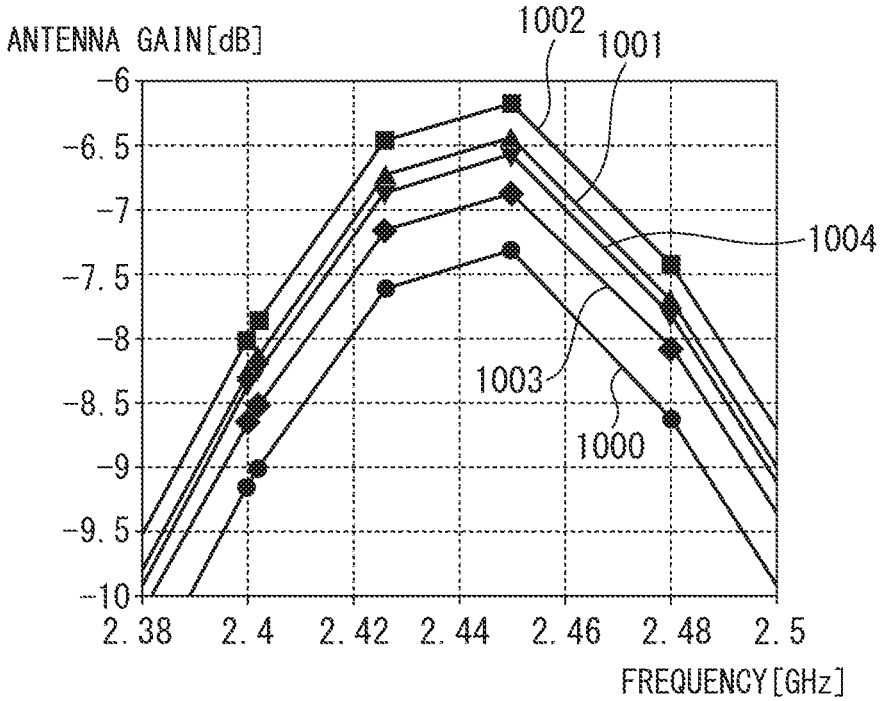
FIG. 10 is a diagram illustrating the frequency characteristics of an antenna gain in the front direction obtained by electromagnetic field simulation, when the loop antenna according to the first embodiment and the loop antennas according to the respective modification examples illustrated in FIG. 8A to FIG. 9B are placed in the air.

FIG. 10 illustrates the frequency characteristics of an antenna gain in the front direction obtained by the electromagnetic field simulation, when the loop antenna 1 according to the first embodiment and the loop antennas according to the respective modification examples illustrated in FIG. 8A to FIG. 9B are placed in the air. Note that in this electromagnetic field simulation, the size of each part of the loop antenna 1 and the loop antennas according to the respective modification examples is assumed to be the same as those in FIG. 2, except for the radiation conductor. In the modification example illustrated in FIG. 8A and FIG. 8B, the portion of the radiation conductors 51-1 and 51-2 provided on the front surface of the substrate 2 has a width of 1 mm from the side surface, and the interval between the component installation space 7 and the radiation conductors 51-1 and 51-2 is 1 mm. Note that the size concerning the portion of the radiation conductors 52-1 and 52-2 provided on the side surface of the substrate 2 is the same as illustrated in FIG. 2. In the modification example illustrated in FIG. 9A, the width of the gap 8 provided between the radiation conductor 52-1 and the loop radiation conductor 4 at each of the side surfaces of the substrate 2 is 1 mm. Furthermore, in the modification example illustrated in FIG. 9B, the width of the gap 8 is 1 mm, and the interval from the back surface of the substrate 2 to the bridge conductor 9 is 1.5 mm.

In FIG. 10, the horizontal axis represents a frequency, and the vertical axis represents an antenna gain in the front direction in the impedance matched condition. The graph 1000 represents the frequency characteristics of the antenna gain for the loop antenna according to the comparative example, and the graph 1001 represents the frequency characteristics of the antenna gain for the loop antenna 1 according to the first embodiment, which were referred to in FIG. 4. Note that the graph 1000 and the graph 1001 are illustrated for comparison with the loop antenna in each modification example. The graph 1002 represents the frequency characteristics of the antenna gain for the loop antenna 21 according to the modification example illustrated in FIG. 8A and FIG. 8B. The graph 1003 and the graph 1004 each represent the frequency characteristics of the antenna gain for the loop antenna according to the modification example illustrated in FIG. 9A and FIG. 9B.

As illustrated in graph 1000 to graph 1004, it can be understood that the antenna gain for any modification examples illustrated in FIG. 8A to FIG. 9B is improved compared to the antenna gain for the loop antenna according to the comparative example. In addition, the antenna gain when the gap 8 is eliminated improves more than the antenna gain when the gap 8 is formed between the radiation conductor and the loop radiation conductor. Furthermore, as illustrated in FIG. 8A, by extending the radiation conductors 52-1 and 52-2 up to the front surface side of the substrate 2, the antenna gain improves more.

According to a still another modification example, the loop radiation conductor 4 may be formed to surround the circumference of the substrate 2 along the lengthwise direction and the sectional direction of the substrate 2. In this case, on at least one of the side surfaces of the substrate 2 in the widthwise direction, a radiation conductor may be mounted.

The loop antenna according to the embodiments or each modification example described above may be placed so that the side surface of the substrate on which the radiation conductor is mounted contacts with another conductor.

Figure 11:
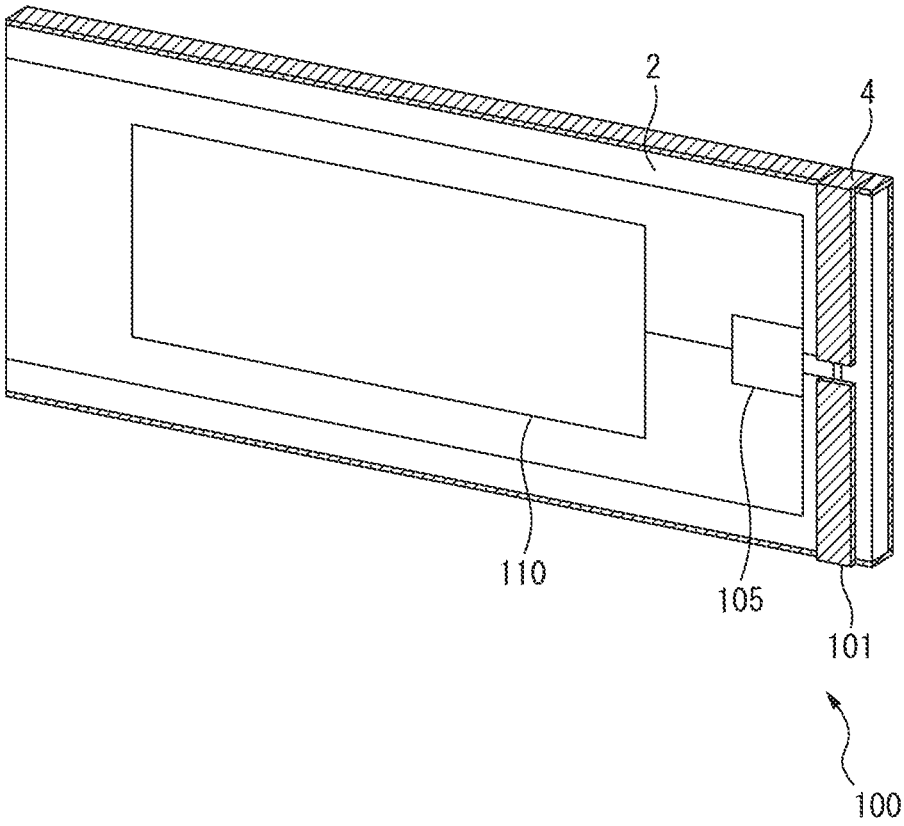
FIG. 11 is a schematic perspective view of an electronic device including the loop antenna according to any of the above-stated embodiments or their modification examples, viewed from the front surface side of the substrate.
Figure 12:
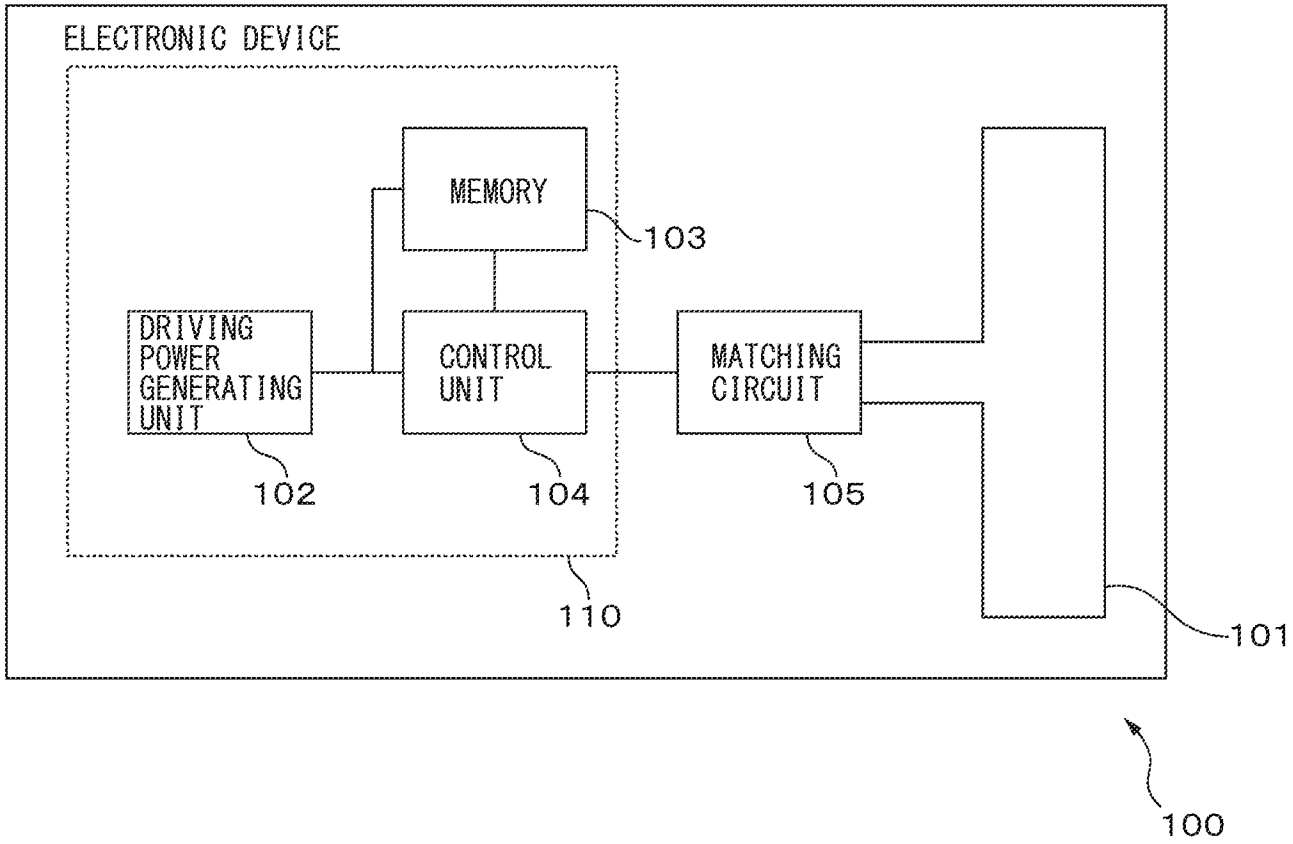
FIG. 12 is a block diagram of circuitry included in the electronic device illustrated in FIG. 11.

FIG. 11 is a schematic perspective view of an electronic device including the loop antenna according to any of the above-stated embodiments or their modification examples, viewed from the front surface side of the substrate 2. FIG. 12 is a block diagram of circuitry included in the electronic device. In this example, the electronic device 100 is a beacon apparatus, and includes a loop antenna 101, a driving power generating unit 102, a memory 103, a control unit 104, and a matching circuit 105. Among them, the driving power generating unit 102, the memory 103, and the control unit 104 are an example of the signal processing circuit 110 that radiates a radio signal via the loop antenna 101. In addition, the memory 103 and the control unit 104 may be formed, for example, as one integrated circuit or a plurality integrated circuits. The signal processing circuit 110 and the matching circuit 105 are installed in an area of the front surface of the substrate 2 of the loop antenna 101 in which the loop radiation conductor 4 is not provided.

The loop antenna 101 is any of the loop antennas according to the above-described embodiments or their modification examples. The loop antenna 101 radiates, for example, a radio signal received via the matching circuit 105 from the control unit 104 as a radio wave.

The driving power generating unit 102 generates a power to drive the memory 103 and the control unit 104. For generation, the driving power generating unit 102 includes, for example, a solar cell. Furthermore, the driving power generating unit 102 may include a power storage element such as a capacitor for storing power generated by the solar cell. The driving power generating unit 102 supplies the generated power to the memory 103 and the control unit 104.

The memory 103 includes a non-volatile semiconductor memory circuit. The memory 103 stores an ID code to identify the electronic device 100 from other electronic devices.

The control unit 104 includes at least one processor and generates a radio signal in accordance with a predetermined radio communication standard, such as BLE. The control unit 104 may read an ID code of the electronic device 100 from the memory 103, and incorporate the ID code into the radio signal. The control unit 104 outputs the radio signal via the matching circuit 105 to the loop antenna 101, and causes the loop antenna 101 to radiate the radio signal as a radio wave.

The matching circuit 105 is connected between the control unit 104 and the power feeding point of the loop antenna 101, to match the impedance of the control unit 104 with the impedance of the loop antenna 101.

Alternatively, the electronic device 100 may be a sensor terminal used for an Internet of Things (IoT). In this case, the electronic device 100 may include one or more sensors for detecting information concerning an object to which the electronic device 100 is attached, with the constituting elements as described above. The control unit 104 may incorporate, into the radio signal, the information obtained from the sensor.

In addition, the electronic device 100 may be a radio tag. In this case, the driving power generating unit 102 may generate a power to drive the memory 103 and the control unit 104, from the radio signal received from the reader/writer (not illustrated in the drawings) via the loop antenna 101. The control unit 104 demodulates a radio signal received from the loop antenna 101, to take an inquiry signal from the radio signal. The control unit 104 may generate a response signal corresponding to the inquiry signal. The control unit 104 reads an ID code from the memory 103, and incorporates the ID code into the response signal. The control unit 104 superposes the response signal onto a radio signal having a frequency to radiate from the loop antenna 101. Then, the control unit 104 outputs the radio signal via the matching circuit 105 to the loop antenna 101, and causes the loop antenna 101 to radiate the radio signal as a radio wave.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. A loop antenna comprising: a substrate; a first conductor which is provided on a first surface of the substrate, is conductive and is grounded; a second conductor which is formed as a loop to surround the substrate along a surface orthogonal to the first surface, is conductive, is fed on a second surface of the substrate, which is opposite to the first surface, and is electrically connected to the first conductor; and a third conductor which is provided on at least one side surface of the substrate, which intersects the surface on which the second conductor is formed as a loop, is conductive and is electrically connected to the first conductor, wherein a length of the third conductor along a lengthwise direction of the side surface of the substrate is longer than a width of the second conductor in the lengthwise direction of the substrate.

2. The loop antenna according to claim 1, wherein
the third conductor is electrically connected to the second conductor on the side surface of the substrate on which the third conductor is provided.

3. The loop antenna according to claim 1, wherein
the third conductor extends from the side surface of the substrate on which the third conductor is provided to the second surface of the substrate.

4. The loop antenna according to claim 1, wherein
the third conductor and the second conductor are provided with a gap therebetween, on the side surface of the substrate on which the third conductor is provided.

5. An electronic device comprising: a loop antenna; a signal processing circuit configured to radiate or receive a radio wave via the loop antenna; and a matching circuit connected between the loop antenna and the signal processing circuit, the matching circuit being configured to match an impedance of the loop antenna with an impedance of the signal processing circuit, wherein the loop antenna includes: a substrate; a first conductor which is provided on a first surface of the substrate, is conductive and is grounded; a second conductor which is formed as a loop to surround the substrate along a surface orthogonal to the first surface, is conductive, is fed on a second surface of the substrate, which is opposite to the first surface, and is electrically connected to the first conductor; and a third conductor which is provided on at least one side surface of the substrate, which intersects the surface on which the second conductor is formed as a loop, is conductive and is electrically connected to the first conductor, and the signal processing circuit and the matching circuit are provided on an area of the second surface of the substrate, in which the second conductor is not formed, wherein a length of the third conductor along the lengthwise direction of the side surface of the substrate is longer than a width of the second conductor in the lengthwise direction of the substrate.

* * * * *